US009689051B2

(12) United States Patent
Hatano et al.

(10) Patent No.: US 9,689,051 B2
(45) **Date of Patent: *Jun. 27, 2017**

(54) HOLLOW SEAMLESS PIPE FOR HIGH-STRENGTH SPRINGS

(75) Inventors: Hitoshi Hatano, Hyogo (JP); Kotaro Toyotake, Fukuoka (JP)

(73) Assignees: Kobe Steel, Ltd., Kobe-shi (JP); SHINKO METAL PRODUCTS CO., LTD., Kitakyushu-shi (JP); NHK SPRING CO., LTD., Yokohama-shi (JP)

( * ) Notice: Subject to any disclaimer, the term of this patent is extended or adjusted under 35 U.S.C. 154(b) by 1078 days.

This patent is subject to a terminal disclaimer.

(21) Appl. No.: 13/320,619

(22) PCT Filed: May 14, 2010

(86) PCT No.: PCT/JP2010/058233

§ 371 (c)(1),
(2), (4) Date: Nov. 15, 2011

(87) PCT Pub. No.: WO2010/131754

PCT Pub. Date: Nov. 18, 2010

(65) Prior Publication Data

US 2012/0070682 A1 Mar. 22, 2012

(30) Foreign Application Priority Data

May 15, 2009 (JP) ..... 2009-119030

(51) Int. Cl.

| | |
|---|---|
| ***C22C 38/02*** | (2006.01) |
| ***C21D 9/02*** | (2006.01) |
| ***C21D 8/10*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |

(52) U.S. Cl.

CPC ..... *C21D 9/02* (2013.01); *C21D 8/105* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C21D 2211/005* (2013.01); *Y10T 428/12292* (2015.01)

(58) Field of Classification Search

CPC ..... C22C 38/02

See application file for complete search history.

(56) References Cited

U.S. PATENT DOCUMENTS

| | | | | |
|---|---|---|---|---|
| 2009/0020189 | A1* | 1/2009 | Yoshihara et al. | 148/506 |
| 2010/0037976 | A1* | 2/2010 | Toyotake et al. | 138/177 |

FOREIGN PATENT DOCUMENTS

| | | |
|---|---|---|
| EP | 2 017 358 A2 | 1/2009 |
| JP | 01 247532 | 10/1989 |
| JP | 2001 247931 | 9/2001 |
| JP | 2002 194432 | 7/2002 |
| JP | 2007 125588 | 5/2007 |
| JP | 2007 231353 | 9/2007 |
| JP | 2007 270349 | 10/2007 |
| JP | 2008 150669 | 7/2008 |
| WO | WO 2008/111200 A1 | 9/2008 |
| WO | WO 2008111200 A1 * | 9/2008 |

OTHER PUBLICATIONS

US 2010/0037976 A1 is the English equivalent of WO 2008111200 A1.*

Claims of U.S. Appl. No. 14/389,866 dated Oct. 1, 2014.*

Office Action issued Aug. 6, 2013 in Chinese Patent Application No. 201080021286.1 with English language translation.

Combined Chinese Office Action and Search Report issued Jan. 14, 2013, in Chinese Patent Application No. 201080021286.1 with English translation of Category of cited documents.

International Search Report Issued Jul. 27, 2010 in PCT/JP10/058233 Filed May 14, 2010.

Written Opinion issued Jul. 12, 2010 in PCT/JP10/058233 Filed May 14, 2010 (with partial English translation).

Extended European Search Report issued Jun. 5, 2015 in Patent Application No. 10775011.9.

* cited by examiner

*Primary Examiner* — Roy King
*Assistant Examiner* — Jophy S Koshy
(74) *Attorney, Agent, or Firm* — Oblon, McClelland, Maier & Neustadt, L.L.P.

(57) ABSTRACT

A hollow seamless pipe for a high-strength spring with reduced occurrence of decarburization in the inner and outer peripheral surfaces, hardened surface layers in the inner and outer peripheral surfaces during quenching, and sufficient fatigue strength is provided. The hollow seamless pipe contains a steel material, which includes 0.2 to 0.7 mass % of C, 0.5 to 3 mass % of Si, 0.1 to 2 mass % of Mn, more than 0 and 0.1 mass % or less of Al, more than 0 and 0.02 mass % or less of P, more than 0 and 0.02 mass % or less of S, and more than 0 and 0.02 mass % or less of N. The C content in the inner and outer peripheral surfaces is 0.10 mass % or more. A thickness of a whole decarburized layer in each of the inner peripheral surface and the outer peripheral surface is 200 μm or less.

5 Claims, No Drawings

HOLLOW SEAMLESS PIPE FOR HIGH-STRENGTH SPRINGS

TECHNICAL FIELD

The present invention relates to a hollow seamless pipe for high-strength springs used in valve springs or suspension springs or the like of internal combustion of automobiles or the like, and particularly to a hollow seamless pipe for high-strength springs in which decarburization in an outer peripheral surface and inner peripheral surface thereof is reduced.

BACKGROUND ART

With a recent increasing demand for lightweight or higher output of automobiles for the purpose of a decrease in exhaust gas or improvement of fuel efficiency, high stress design has also been required for valve springs, clutch springs, suspension springs and the like which are used in engines, clutches, suspensions and the like. These springs tend to have higher strength and thinner diameter, and the load stress tends to further increase. In order to comply with such a tendency, a spring steel having higher performance in fatigue resistance and settling resistance has been strongly desired.

Further, in order to realize lightweight while maintaining fatigue resistance and settling resistance, hollow pipe-shaped steel materials having no welded part (that is to say, seamless pipes) have come to be used as materials of springs, instead of rod-shaped wire rods which have hitherto been used as materials of springs (that is to say, solid wire rods).

Techniques for producing the hollow seamless pipes as described above have also hitherto been variously proposed. For example, Patent Document 1 proposes a technique of performing piercing by using a Mannesmann piercer which should be said to be a representative of piercing rolling mills (Mannesmann piercing), then, performing mandrel mill rolling (draw rolling) under cold conditions, further, performing reheating under conditions of 820 to 940° C. and 10 to 30 minutes, and thereafter, performing finish rolling.

On the other hand, Patent Document 2 proposes a technique of performing hydrostatic extrusion under hot conditions to form a hollow seamless pipe, and thereafter, performing spheroidizing annealing, followed by performing extension (draw benching) by Pilger mill rolling, drawing or the like under cold conditions. Further, in this technique, it is also shown that annealing is finally performed at a predetermined temperature.

In the respective techniques as described above, when the Mannesmann piercing or the hot hydrostatic extrusion is performed, it is necessary to heat at 1,050° C. or more or to perform annealing before or after cold working, and there is a problem that decarburization is liable to occur in an inner peripheral surface and outer peripheral surface of the hollow seamless pipe at the time of heating or working under hot conditions or in a subsequent heat treatment process. Further, at the time of cooling after the heat treatment, decarburization (ferrite decarburization) caused by the difference between the solute amount of carbon in ferrite and that in austenite also occurs in some cases.

When the decarburization as described above occurs, it happens that surface layer parts are not sufficiently hardened in the outer peripheral surface and inner peripheral surface in a quenching step at the time of spring production, which causes a problem that sufficient fatigue strength cannot be secured in springs to be formed. Further, in the case of usual springs, residual stress is usually imparted to an outer surface by shot peening or the like to improve the fatigue strength. However, in the case of springs formed by the hollow seamless pipe, shot peening cannot be performed in the inner peripheral surface, and flaws are liable to occur in the inner peripheral surface by a conventional processing method. Accordingly, there is also a problem that it becomes difficult to secure the fatigue strength of the inner surface.

PRIOR-ART DOCUMENTS

Patent Documents

Patent Document 1: JP-A-Hei 1-247532
Patent Document 2: JP-A-2007-125588

SUMMARY OF THE INVENTION

Problems that the Invention is to Solve

The invention has been made under such circumstances, and an object thereof is to provide a hollow seamless pipe for high-strength springs, in which the occurrence of decarburization in an inner peripheral surface and outer peripheral surface thereof is reduced as much as possible, surface layer parts can be sufficiently hardened in the outer peripheral surface and inner peripheral surface in a quenching step at the time of spring production, and sufficient fatigue strength can be secured in springs to be formed.

Means for Solving the Problems

The present invention includes the following embodiments.

(1) A hollow seamless pipe for a high-strength spring, which is composed of a steel material comprising 0.2 to 0.7 mass % of C, 0.5 to 3 mass % of Si, 0.1 to 2 mass % of Mn, more than 0 mass % and 0.1 mass % or less of Al, more than 0 mass % and 0.02 mass % or less of P, more than 0 mass % and 0.02 mass % or less of S, and more than 0 mass % and 0.02 mass % or less of N, wherein the C content in an inner peripheral surface and outer peripheral surface of the hollow seamless pipe is 0.10 mass % or more, and a thickness of a whole decarburized layer in each of the inner peripheral surface and the outer peripheral surface is 200 μm or less.

(2) The hollow seamless pipe for a high-strength spring according to (1), wherein an average grain size of ferrite in an inner surface layer part is 11.7 μm or less, preferably 10 μm or less.

(3) The hollow seamless pipe for a high-strength spring according to (1), wherein a maximum depth of a flaw which is present in the inner peripheral surface is 20 μm or less.

(4) The hollow seamless pipe for a high-strength spring according to (2), wherein a maximum depth of a flaw which is present in the inner peripheral surface is 20 μm or less.

(5) The hollow seamless pipe for a high-strength spring according to any one of (1) to (4), which further comprises at least one group of the following groups (a) to (g):

(a) more than 0 mass % and 3 mass % or less of Cr, (b) more than 0 mass % and 0.015 mass % or less of B, (c) one or more kinds selected from the group consisting of more than 0 mass % and 1 mass % or less of V, more than 0 mass % and 0.3 mass % or less of Ti, and more than 0 mass % and 0.3 mass % or less of Nb, (d) one or more kinds selected from the group consisting of more than 0 mass % and 3 mass % or less of Ni, and more than 0 mass % and 3 mass % or less of Cu, (e) more than 0 mass % and 2 mass % or less of Mo, (f) one or more kinds selected from the group consisting of more than 0 mass % and 0.005 mass % or less of Ca, more than 0 mass % and 0.005 mass % or less of Mg, and more than 0 mass % and 0.02 mass % or less of REM, and (g) one or more kinds selected from the group consisting of more than 0 mass % and 0.1 mass % or less of Zr, more than 0 mass % and 0.1 mass % or less of Ta, and more than 0 mass % and 0.1 mass % or less of Hf.

Advantages of the Invention

In the invention, a chemical component composition of a steel material as a material is properly adjusted, and production conditions thereof are strictly defined, thereby being able to realize a hollow seamless pipe, in which no ferrite decarburization is occurred in an inner peripheral surface and outer peripheral surface and a thickness of a decarburized layer is reduced as much as possible. It becomes possible to secure sufficient fatigue strength in a spring formed from such a hollow seamless pipe.

MODE FOR CARRYING OUT THE INVENTION

The present inventors have studied conditions for preventing the occurrence of decarburization from various angles. As a result, it has become clear that what is necessary is just to perform usual hot rolling, in which low-temperature rolling and controlled cooling are possible, to produce a rod material having no decarburization, thereafter, to pierce it with a gun drill, and to cool it under predetermined cooling conditions, followed by forming it in a final shape by cold rolling or draw benching (cold working), instead of hollowing by hot hydrostatic extrusion or Mannesmann piercing in which it is relatively difficult to control the cooling rate after working. According to such a production method, it becomes possible to produce a hollow seamless pipe having no decarburization in both an outer peripheral surface and an inner peripheral surface thereof (that is to say, the C content in the surface is 0.10 mass % or more, and the thickness of the whole decarburized layer is 200 μm or less). Incidentally, the above-mentioned whole decarburized layer means a part having a carbon concentration of less than 95% of that in a center part in the thickness of the pipe.

Further, according to the production method as described above, the austenite grain size at the time of spring quenching can be refined by microstructure refining in the hollow pipe, and it also becomes possible to improve fatigue strength. Specifically, after the reduction ratio (reduction of area) at the time of cold working is adjusted to 50% or more, a recrystallization treatment (annealing) is performed at a relatively low temperature of about 650 to 700° C., whereby it becomes possible to reduce the average grain size of ferrite in an inner surface layer part to 11.7 μm or less, preferably 10 μm or less. Incidentally, the above-mentioned inner surface layer part means a region from a surface of the inner peripheral surface of the hollow seamless pipe to a depth of 500 μm.

Further, according to the above-mentioned method, the subsequent cold working (cold rolling or cold draw benching) process can be shortened by hollowing with the gun drill, and inner surface flaws which have occurred by the Mannesmann piercing, the hot hydrostatic extrusion, or the cold rolling or draw benching can be substantially reduced. According to the invention, the inner surface flaws can be reduced to 20 μm or less in terms of the maximum depth, although the limit has hitherto been about 50 μm in terms of the maximum depth.

The hollow seamless pipe of the invention can be produced according to the procedure described above to a steel material in which a chemical component composition is properly adjusted (the proper chemical component composition will be described later). Respective processes in this production method will be described more specifically.

(Hollowing Technique)

First, as a hollowing technique, usual hot rolling, in which the heating temperature of a billet can be decreased and low-temperature rolling and controlled cooling are possible, is performed to prepare a solid round bar, followed by hollowing by a gun drill method or the like. Thereafter, it is formed to a predetermined diameter and length by the draw benching or the cold rolling, thereby being able to obtain a seamless pipe small in both ferrite decarburization and total decarburization (whole decarburization) in both the outer peripheral surface and inner peripheral surface. Further, by such processes, there are exhibited effects of being able to decrease the reduction ratio at the time of cold working and being able to improve quality of the inner peripheral surface (that is to say, being able to reduce the size of the flaws).

(Heating Temperature at the Time of Hot Rolling: Less than 1,050° C.)

In the above-mentioned hot rolling process, the heating temperature thereof is recommended to be less than 1,050° C. When the heating temperature thereof is 1,050° C. or more, the total decarburization tends to increase. Preferably, it is 1,020° C. or less.

(Minimum Rolling Temperature at the Time of Hot Rolling: 850° C. or More)

It is also preferred that the minimum rolling temperature at the time of hot rolling is adjusted to 850° C. or more. When this rolling temperature is too low, ferrite tends to be easily formed on the surfaces (the outer peripheral surface and the inner peripheral surface). The temperature thereof is preferably 900° C. or more.

(Cooling Conditions after Rolling: the Average Cooling Rate Until the Temperature is Achieved to 720° C. after Rolling is 1.5° C./Sec or More, and Thereafter, the Average Cooling Rate Until the Temperature is Achieved to 500° C. is 0.5° C./Sec or Less)

After hot rolling is performed under the conditions as described above, forced cooling is performed until the temperature is achieved to 720° C., thereby being able to prevent ferrite generation (the occurrence of ferrite decarburization) on the surfaces. In order to exhibit such a cooling effect, it is preferred that the average cooling rate until the temperature is achieved to 720° C. is adjusted to 1.5° C./sec or more. It is preferred that the average cooling rate thereof is adjusted to 2° C./sec or more. After such forced cooling is performed, cooling is performed until the temperature is achieved to 500° C. at an average cooling rate of 0.5° C./sec or less. When the cooling rate from the end temperature of the above-mentioned forced cooling to 500° C. is too fast, the steel material is quenched, resulting in taking time for softening in the subsequent heat treatment or annealing. From such a viewpoint, it is desirable that the average cooling rate until the temperature is achieved to 500° C. is adjusted to 0.5° C./sec or less (for example, allowed to stand to cool). More preferably, it is 0.3° C./sec or less.

(Cold Working Conditions)

After the controlled cooling as described above is performed (and after gun drill piercing), cold working is performed. As the cold working at this time, the draw benching or the cold rolling is recommended. When such working is performed, the working of 50% or more in terms of the reduction of area (RA) is performed, and thereafter, recrystallization (heat treatment or annealing) is performed at temperature of 750° C. or less, thereby being able to reduce the average grain size of ferrite to 11.7 μm or less, preferably 10 μm or less. The austenite (γ) grain size is refined in the heat treatment at the time of the spring production, thereby having an effect of improving the fatigue life of the spring. In the above-mentioned cold working, it is more effective that the heat treatment or annealing is performed at 700° C. or less, with the reduction of area to 50% or more.

(Heat Treatment or Annealing Process)

After the above-mentioned cold working, heat treatment or annealing is performed as needed. The heating temperature thereof is required to be within a ferrite temperature region, because when heated to a region where austenite is formed (spheroidizing heat treatment or annealing), decarburization is liable to occur. Further, from the viewpoint of reducing the average grain size of ferrite to 11.7 μm or less, preferably 10 μm or less as described above, the heating temperature thereof is preferably a relatively low temperature of 650 to 700° C.

In the hollow seamless pipe of the invention, it is also important that the chemical component composition of the steel material used as the material is properly adjusted. Reasons for limiting the ranges of chemical components will be described below.

(C: 0.2 to 0.7% (% Means "Mass %", Hereinafter the Same is Applied for the Chemical Component Composition))

C is an element necessary for securing high strength, and for that purpose, it is necessary that C is contained in an amount of 0.2% or more. The C content is preferably 0.30% or more, and more preferably 0.35% or more. However, when the C content becomes excessive, it becomes difficult to secure ductility. Accordingly, the C content is required to be 0.7% or less. The C content is preferably 0.65% or less, and more preferably 0.60% or less.

(Si: 0.5 to 3%)

Si is an element effective for improving settling resistance necessary for springs. In order to obtain settling resistance necessary for springs having a strength level intended in the invention, the Si content is required to be 0.5% or more. The Si content is preferably 1.0% or more, and more preferably 1.5% or more. However, Si is also an element which accelerates decarburization. Accordingly, when Si is contained in an excessive amount, formation of decarburized layer on the surfaces of the steel material is accelerated. As a result, a peeling process for removing the decarburized layer becomes necessary, and thus, this is disadvantageous in terms of production cost. Accordingly, the upper limit of the Si content is limited to 3% in the invention. The Si content is preferably 2.5% or less, and more preferably 2.2% or less.

(Mn: 0.1 to 2%)

Mn is utilized as a deoxidizing element, and is an advantageous element which forms MnS with S as a harmful element in the steel material to render it harmless. In order to effectively exhibit such an effect, it is necessary that Mn is contained in an amount of 0.1% or more. The Mn amount is preferably 0.15% or more, and more preferably 0.20% or more. However, when the Mn content becomes excessive, a segregation band is formed to cause the occurrence of variations in quality of the material. Accordingly, the upper limit of the Mn content is limited to 2% in the invention. The Mn content is preferably 1.5% or less, and more preferably 1.0% or less.

(Al: 0.1% or Less (not Including 0%))

Al is mainly added as a deoxidizing element. Further, it not only forms AlN with N to render solute N harmless, but also contributes to refinement of a microstructure. Particularly, in order to fix the solute N, it is preferred that Al is contained in an amount of more than twice the N content. However, Al is an element which accelerates decarburization, as is the case with Si. Accordingly, in a spring steel containing a large amount of Si, it is necessary to inhibit Al from being added in large amounts. In the invention, the Al content is 0.1% or less, preferably 0.07% or less, and more preferably 0.05% or less.

(P: 0.02% or Less (not Including 0%))

P is a harmful element which deteriorates toughness and ductility of the steel material, so that it is important that P is decreased as much as possible. In the invention, the upper limit thereof is limited to 0.02%. It is preferred that the P content is suppressed preferably to 0.010% or less, and more preferably to 0.008% or less. Incidentally, P is an impurity unavoidably contained in the steel material, and it is difficult in industrial production to decrease the amount thereof to 0%.

(S: 0.02% or Less (not Including 0%))

S is a harmful element which deteriorates toughness and ductility of the steel material, as is the case with P described above, so that it is important that S is decreased as much as possible. In the invention, the S content is suppressed to 0.02% or less, preferably 0.010% or less, and more preferably 0.008% or less. Incidentally, S is an impurity unavoidably contained in the steel, and it is difficult in industrial production to decrease the amount thereof to 0%.

(N: 0.02% or Less (not Including 0%))

N has an effect of forming a nitride to refine the microstructure, when Al, Ti or the like is present. However, when N is present in a solute state, N deteriorates toughness, ductility and hydrogen embrittlement resistance properties of the steel material. In the invention, the upper limit of the N content is limited to 0.02%. The N content is preferably 0.010% or less, and more preferably 0.0050% or less.

In the steel material applied in the invention, the others (remainder) of the above-mentioned component is composed of iron and unavoidable impurities (for example, Sn, As and the like), but trace components (allowable components) can be contained therein to such a degree that properties thereof are not impaired. Such a steel material is also included in the range of the invention.

Further, it is also effective that (a) 3% or less (not including 0%) of Cr, (b) 0.015% or less (not including 0%) of B, (c) one or more kinds selected from the group consisting of 1% or less (not including 0%) of V, 0.3% or less (not including 0%) of Ti and 0.3% or less (not including 0%) of Nb, (d) 3% or less (not including 0%) of Ni and/or 3% or less (not including 0%) of Cu, (e) 2% or less (not including 0%) of Mo, (f) one or more kinds selected from the group consisting of 0.005% or less (not including 0%) of Ca, 0.005% or less (not including 0%) of Mg and 0.02% or less (not including 0%) of REM, (g) one or more kinds selected from the group consisting of 0.1% or less (not including 0%) of Zr, 0.1% or less (not including 0%) of Ta and 0.1% or less (not including 0%) of Hf, or the like is contained, as needed. Reasons for limiting the ranges at the time when these components are contained are as follows.

(Cr: 3% or Less (not Including 0%))

From the viewpoint of improving cold workability, the smaller Cr content is preferred. However, Cr is an element effective for securing strength after tempering and for improving corrosion resistance, and is an element particularly important in suspension springs in which high-level corrosion resistance is required. Such an effect increases with an increase in the Cr content. In order to preferentially exhibit such an effect, it is preferred that Cr is contained in an amount of 0.2% or more, and more preferably 0.5% or more. However, when the Cr content becomes excessive, not only a supercooled microstructure is liable to occur, but also segregation to cementite occurs to reduce plastic deformability, which causes deterioration of cold workability in some cases. Further, when the Cr content becomes excessive, Cr carbides different from cementite are liable to be formed, resulting in an unbalance between strength and ductility in some cases. Accordingly, in the steel material used in the invention, it is preferred that the Cr content is suppressed to 3% or less. The Cr content is more preferably 2.0% or less, and still more preferably 1.7% or less.

(B: 0.015% or Less (not Including 0%)) B has an effect of inhibiting fracture from prior austenite grain boundaries after quenching-tempering of the steel material. In order to exhibit such an effect, it is preferred that B is contained in an amount of 0.001% or more. However, when B is contained in an excessive amount, coarse carboborides are formed to impair the properties of the steel material in some cases. Further, when B is contained more than necessary, it contributes to the occurrence of flaws of a rolled material in some cases. Accordingly, the upper limit of the B content is limited to 0.015%. The B content is more preferably 0.010% or less, and still more preferably 0.0050% or less.

(One or More Kinds Selected from the Group Consisting of V: 1% or Less (not Including 0%); Ti: 0.3% or Less (not Including 0%); and Nb: 0.3% or Less (not Including 0%))

V, Ti and Nb form carbo-nitrides (carbides, nitrides and carbonitrides), sulfides or the like with C, N, S and the like to have an action of rendering these elements harmless, and further form carbo-nitrides to also exhibit an effect of refining the microstructure. Furthermore, they also have an effect of improving delayed fracture resistance properties. In order to exhibit these effects, it is preferred that at least one kind of Ti, V and Nb is contained in an amount of 0.02% or more (in an amount of 0.2% or more in total when two or more kinds are contained). However, the contents of these elements become excessive, coarse carbo-nitrides are formed to deteriorate toughness or ductility in some cases. Accordingly, in the invention, the upper limits of the contents of Ti, V and Nb are preferably 1%, 0.3% and 0.3%, respectively. 0.5% or less of V, 0.1% or less of Ti and 0.1% or less of Nb are more preferred. In addition, from the viewpoint of cost reduction, 0.3% or less of V, 0.05% or less of Ti and 0.05% or less of Nb are preferred.

(Ni: 3% or Less (not Including 0%) and/or Cu: 3% or Less (not Including 0%))

For Ni, addition thereof is restrained in the case of taking into consideration cost reduction, so that the lower limit thereof is not particularly provided. However, in the case of inhibiting surface layer decarburization or improving corrosion resistance, it is preferred that Ni is contained in an amount of 0.1% or more. However, when the Ni content becomes excessive, the supercooled microstructure occurs in the rolled material, or residual austenite is present after quenching, resulting in deterioration of the properties of the steel material in some cases. Accordingly, when Ni is contained, the upper limit thereof is preferably 3%. From the viewpoint of cost reduction, the Ni content is preferably 2.0% or less, and more preferably 1.0% or less.

Cu is an element effective for inhibiting surface layer decarburization or improving corrosion resistance, as is the case with Ni described above. In order to exhibit such an effect, it is preferred that Cu is contained in an amount of 0.1% or more. However, when the Cu content becomes excessive, the supercooled microstructure occurs or cracks occur at the time of hot working in some cases. Accordingly, when Cu is contained, the upper limit thereof is preferably 3%. From the viewpoint of cost reduction, the Cu content is preferably 2.0% or less, and more preferably 1.0% or less.

(Mo: 2% or Less (not Including 0%))

Mo is an element effective for securing strength and improving toughness after tempering. However, the Mo content becomes excessive, toughness deteriorates in some cases. Accordingly, the upper limit of the Mo content is preferably 2%. The Mo content is more preferably 0.5% or less.

(One or More Kinds Selected from the Group Consisting of Ca: 0.005% or Less (not Including 0%); Mg: 0.005% or Less (not Including 0%); and REM: 0.02% or Less (not Including 0%))

All of Ca, Mg and REM (rare earth element) form sulfides to prevent elongation of MnS, thereby having an effect of improving toughness, and can be added depending on required properties. However, when they are added in excess of the above-mentioned upper limits, respectively, toughness is adversely deteriorated in some cases. The respective preferred upper limits are 0.0030% for Ca, 0.0030% for Mg and 0.010% for REM. Incidentally, in the invention, REM means to include lanthanoid elements (15 elements from La to Ln), Sc (scandium) and Y (yttrium).

(One or More Kinds Selected from the Group Consisting of Zr: 0.1% or Less (not Including 0%); Ta: 0.1% or Less (not Including 0%); and Hf: 0.1% or Less (not Including 0%))

These elements combine with N to form nitrides, thereby stably inhibiting the growth of the austenite (γ) grain size at the time of heating to refine the final microstructure, which causes an effect of improving toughness. However, when each of them is added in an excessive amount of more than 0.1%, the nitrides are coarsened to deteriorate fatigue property. This is therefore unfavorable. Accordingly, the upper limit of each of them is limited to 0.1%. The more preferred upper limit of each of them is 0.05%, and the still more preferred upper limit is 0.025%.

The invention will be described below in more detail with reference to examples, but the following examples should not be construed as limiting the invention. All design changes in the context of the spirit described above and later are included in the technical scope of the invention.

EXAMPLES

Various kinds of molten steels having the chemical component compositions shown in Table 1 were each melted by a usual melting method. The molten steels were cooled and bloom rolled to form slabs having a cross-sectional shape of 155 mm×155 mm. Thereafter, hot rolling and cooling were preformed under the conditions shown in Table 2 described below to obtain bar steels having a diameter of 25 mm. Incidentally, in Tables 1 and 2 described below, REM was added in a form of a misch metal containing about 50% of La and about 25% of Ce. In Tables 1 and 2 described below, "-" shows that no element was added. Incidentally, Cooling Rate 1 in Table 2 means the average cooling rate at the time when cooled to 720° C. after hot rolling, and Cooling Rate 2 means the average cooling rate at the time when cooled from the end temperature of the above-mentioned cooling to 500° C.

An inside of the resulting bar steel was pierced to have an inner diameter of 12 mm by using a gun drill. Thereafter, cold rolling was performed to prepare a hollow seamless pipe having an outer diameter of 16 mm and an inner diameter of 8 mm. In the course thereof, heat treatment or annealing was performed at a stage of an outer diameter of 20 mm and an inner diameter of 10 mm in some materials (Test Nos. 2 to 4 in Table 2 described below). Incidentally, for Test Nos. 2 to 4, conditions at a stage of an outer diameter of 20 mm and an inner diameter of 10 mm and conditions at a stage of an outer diameter of 16 mm and an inner diameter of 8 mm are described separately, divided into Cold Rolling Conditions 1 and Annealing Temperature 1, and Cold Rolling Conditions 2 and Annealing Temperature 2, respectively.

Further, as a comparative material, a cylindrical billet having an outer diameter of 143 mm and an inner diameter of 52 mm was prepared from a slab having a cross-sectional shape of 155 mm×155 mm by hot forging and cutting, and a hollow pipe having an outer diameter of 54 mm and an inner diameter of 38 mm was also prepared by using hot hydrostatic extrusion (heating temperature: 1,150° C.) (Test No. 1 in Table 2 described below). After heat treatment or annealing and pickling, draw benching, heat treatment or annealing (700° C.×20 hours) and pickling were repeated 8 times to this hollow pipe to prepare a hollow seamless pipe having an outer diameter of 16 mm and an inner diameter of 8 mm (heat treatment or annealing conditions after draw benching: 750° C.×10 minutes).

TABLE 1

| Steel | Chemical Component Composition (mass %) | | | | | | | | | | |
|---|---|---|---|---|---|---|---|---|---|---|---|
| Species | C | Si | Mn | P | S | Cu | Ni | Cr | Mo | V | Nb |
| A | 0.42 | 1.90 | 0.20 | 0.005 | 0.005 | 0.20 | 0.32 | 1.01 | — | 0.17 | — |
| B | 0.59 | 2.06 | 0.94 | 0.005 | 0.005 | 0.45 | 0.47 | 0.15 | — | — | — |
| C | 0.42 | 1.69 | 0.60 | 0.005 | 0.005 | — | — | 1.00 | — | 0.15 | — |
| D | 0.40 | 1.86 | 0.60 | 0.005 | 0.005 | — | — | 0.99 | — | — | 0.080 |
| E | 0.40 | 1.95 | 0.31 | 0.005 | 0.005 | — | — | — | 0.30 | — | 0.050 |
| F | 0.38 | 1.64 | 0.54 | 0.005 | 0.005 | — | — | 1.00 | — | — | 0.050 |
| G | 0.37 | 1.76 | 0.25 | 0.005 | 0.005 | 0.95 | 0.93 | — | — | 0.21 | — |
| H | 0.24 | 1.13 | 0.86 | 0.005 | 0.005 | 0.95 | 0.93 | — | — | 0.15 | 0.045 |
| I | 0.43 | 1.89 | 0.19 | 0.005 | 0.005 | 0.21 | 0.35 | 0.99 | — | 0.15 | — |
| J | 0.42 | 1.92 | 0.21 | 0.005 | 0.005 | 0.20 | 0.36 | 1.00 | — | 0.14 | — |
| K | 0.42 | 1.88 | 0.20 | 0.005 | 0.005 | 0.21 | 0.35 | 0.99 | — | 0.16 | — |
| L | 0.43 | 1.90 | 0.21 | 0.005 | 0.005 | 0.20 | 0.34 | 1.01 | — | 0.17 | — |
| M | 0.42 | 1.92 | 0.20 | 0.005 | 0.005 | 0.20 | 0.33 | 0.99 | — | 0.15 | — |
| N | 0.42 | 1.90 | 0.20 | 0.005 | 0.005 | 0.21 | 0.35 | 1.01 | — | 0.17 | — |

| Steel | Chemical Component Composition (mass %) | | | | | | | |
|---|---|---|---|---|---|---|---|---|
| Species | Ti | Al | B | Ca | Mg | REM | Zr, Hf, Ta | N |
| A | 0.068 | 0.030 | — | — | — | — | — | 0.0045 |
| B | — | 0.029 | — | — | — | — | — | 0.0042 |
| C | 0.050 | 0.025 | — | — | — | — | — | 0.0049 |
| D | — | 0.023 | 0.0026 | — | — | — | — | 0.0055 |
| E | 0.051 | 0.025 | — | — | — | — | — | 0.0034 |
| F | 0.049 | 0.022 | 0.0020 | — | — | — | — | 0.0042 |
| G | — | 0.026 | — | — | — | — | — | 0.0041 |
| H | 0.076 | 0.021 | 0.0032 | — | — | — | — | 0.0033 |
| I | 0.065 | 0.025 | — | — | — | — | Zr: 0.019 | 0.0043 |
| J | 0.068 | 0.027 | — | — | — | — | Hf: 0.045 | 0.0042 |
| K | 0.070 | 0.031 | — | — | — | — | Ta: 0.032 | 0.0044 |
| L | 0.071 | 0.028 | — | 0.0021 | — | — | — | 0.0041 |
| M | 0.069 | 0.030 | — | — | 0.0010 | — | — | 0.0045 |
| N | 0.070 | 0.031 | — | — | — | 0.0025 | — | 0.0046 |

Remainder: iron and unavoidable impurities other than P and S

TABLE 2

| | | | Hot Rolling Conditions | | Cooling Conditions | |
|---|---|---|---|---|---|---|
| | | | Heating | Minimum Rolling | | |
| Test No. | Steel Species | Hollowing Method | Temperature (° C.) | Temperature (° C.) | Cooling Rate 1 (° C./s) | Cooling Rate 2 (° C./s) |
| 1 | A | Hydrostatic extrusion + draw benching | — | — | — | — |
| 2 | A | Hot rolling + gun drill | 1300 | 900 | 0.5 | 0.2 |
| 3 | A | Hot rolling + gun drill | 1300 | 900 | 2 | 0.5 |
| 4 | A | Hot rolling + gun drill | 1030 | 900 | 2 | 0.5 |

TABLE 2-continued

| | | | | | | |
|---|---|---|---|---|---|---|
| 5 | A | Hot rolling + gun drill | 1030 | 900 | 2 | 0.5 |
| 6 | A | Hot rolling + gun drill | 1000 | 850 | 2 | 0.5 |
| 7 | B | Hot rolling + gun drill | 1000 | 850 | 2 | 0.5 |
| 8 | C | Hot rolling + gun drill | 1030 | 900 | 2 | 0.5 |
| 9 | D | Hot rolling + gun drill | 1030 | 900 | 2 | 0.5 |
| 10 | E | Hot rolling + gun drill | 1030 | 900 | 2 | 0.5 |
| 11 | F | Hot rolling + gun drill | 1030 | 900 | 2 | 0.5 |
| 12 | G | Hot rolling + gun drill | 1000 | 850 | 2 | 0.5 |
| 13 | H | Hot rolling + gun drill | 1000 | 850 | 2 | 0.5 |
| 14 | I | Hot rolling + gun drill | 1000 | 850 | 2 | 0.5 |
| 15 | J | Hot rolling + gun drill | 1000 | 850 | 2 | 0.5 |
| 16 | K | Hot rolling + gun drill | 1000 | 850 | 2 | 0.5 |
| 17 | L | Hot rolling + gun drill | 1000 | 850 | 2 | 0.5 |
| 18 | M | Hot rolling + gun drill | 1000 | 850 | 2 | 0.5 |
| 19 | N | Hot rolling + gun drill | 1000 | 850 | 2 | 0.5 |

| | Cold Rolling Conditions 1 | | | | Cold Rolling Conditions 2 | | | |
|---|---|---|---|---|---|---|---|---|
| | Finish | | | | Finish | | | |
| Test No. | Outer Diameter (mm) | Inner Diameter (mm) | Reduction of Area (%) | Annealing Temperature 1 (° C.) | Outer Diameter (mm) | Inner Diameter (mm) | Reduction of Area (%) | Annealing Temperature 2 (° C.) |
| 1 | — | — | — | 750 | — | — | — | — |
| 2 | 20 | 10 | 38 | 750 | 16.0 | 8.0 | 36 | 750 |
| 3 | 20 | 10 | 38 | 750 | 16.0 | 8.0 | 36 | 750 |
| 4 | 20 | 10 | 38 | 750 | 16.0 | 8.0 | 36 | 750 |
| 5 | 16 | 8 | 60 | 750 | — | — | — | — |
| 6 | 16 | 8 | 60 | 650 | — | — | — | — |
| 7 | 16 | 8 | 60 | 650 | — | — | — | — |
| 8 | 16 | 8 | 60 | 700 | — | — | — | — |
| 9 | 16 | 8 | 60 | 700 | — | — | — | — |
| 10 | 16 | 8 | 60 | 750 | — | — | — | — |
| 11 | 16 | 8 | 60 | 650 | — | — | — | — |
| 12 | 16 | 8 | 60 | 700 | — | — | — | — |
| 13 | 16 | 8 | 60 | 700 | — | — | — | — |
| 14 | 16 | 8 | 60 | 650 | — | — | — | — |
| 15 | 16 | 8 | 60 | 650 | — | — | — | — |
| 16 | 16 | 8 | 60 | 650 | — | — | — | — |
| 17 | 16 | 8 | 60 | 650 | — | — | — | — |
| 18 | 16 | 8 | 60 | 650 | — | — | — | — |
| 19 | 16 | 8 | 60 | 650 | — | — | — | — |

A center part of the resulting hollow seamless pipe was cut in an axis direction thereof, and the C content was measured using an EPMA, thereby measuring the thickness of decarburized layers (ferrite decarburized layer and whole decarburized layer) and measuring the average grain size of ferrite in the vicinity of an inner peripheral surface (a region from a surface to a depth of 500 μm) with an EBSP. Respective detailed measuring conditions are as follows.

(Measuring Conditions of EPMA)

Acceleration voltage: 15 kV

Irradiation current: 1 μA

Line analysis direction: from the outside of the pipe to the inside thereof.

For the line analysis, measurement was made by giving the minimum beam diameter (about 3 μm) and swing by the beam in a width of 30 μm. At this time, when a part having a C content of less than 0.10% was present in a surface layer part, the ferrite decarburized layer was considered to be present, which was evaluated as "B". When no part having a C content of less than 0.10% was present, no ferrite decarburized layer was considered to be present, which was evaluated as "A". Further, a part having a carbon concentration of less than 95% in a center part of the pipe thickness was considered as the whole decarburized layer, and the thickness thereof was measured. When the thickness of the decarburized layer was 200 μm or less, it was evaluated as "A". In the case of exceeding 200 μm, it was evaluated as "B".

(Measuring Conditions of EBSP)

Region: 300×300 (μm)

Number of frames: 2

Measuring pitch: 0.4 μm

The average grain size was calculated, taking an orientation difference of 15° C. or more as a grain boundary and neglecting 3 μm or less.

Further, the center part of the resulting hollow seamless pipe was cut in a circumferential direction thereof, and the whole circumference was observed with an optical microscope (×400 magnification). The maximum flaw depth at that time was determined. At this time, three cross-sections were observed, and the maximum one was evaluated as the maximum inner peripheral surface flaw depth.

Each of the above-mentioned hollow seamless pipes was quenched and tempered under the following conditions, followed by working to a JIS specimen (JIS Z2274 fatigue specimen)

(Quenching and Tempering Conditions)

Quenching conditions: maintaining at 930° C. for 20 minutes→thereafter, water cooling Tempering conditions: maintaining at 430° C. for 60 minutes (Corrosion Fatigue Test)

The above-mentioned specimen (quenched and tempered specimen) was sprayed with a 5% NaCl aqueous solution at 35° C., and subjected to a rotary bending corrosion fatigue test at a stress of 784 MPa and a rotation rate of 100 rpm.

The presence or absence of breakage up to the number of repeated cycles of $2.0\times10^5$ was examined. The case of $1.0\times10^5$ cycles or more was evaluated as "B", and the case where no breakage occurred up to $2.0\times10^5$ cycles was evaluated as "A" (the case where breakage occurred up to less than that was evaluated as "C").

These results are shown together in Table 3 described below. As apparent from these results, the hollow seamless pipes obtained under the proper production conditions (Test Nos. 5 to 19, examples of the invention) satisfy the requirements specified in the invention, and it is revealed that the ones having good fatigue strength for springs are obtained.

On the other hand, the ones of Test Nos. 1 to 3 (comparative examples) does not satisfy the requirements specified in the invention because of the improper production methods, and it is revealed that the fatigue strength for springs is deteriorated. Incidentally, in Test No. 4, the average grain size of ferrite which is the preferred requirement is coarsened, so that the fatigue strength for springs is somewhat decreased.

TABLE 3

| Test No. | Steel Species | Ferrite Decarburization Evaluation | | Total Decarburization Evaluation | | Grain Size in Vicinity of |
|---|---|---|---|---|---|---|
| | | Outer Peripheral Surface | Inner Peripheral Surface | Outer Peripheral Surface | Inner Peripheral Surface | Inner Peripheral Surface (μm) |
| 1 | A | B | B | B | B | — |
| 2 | A | B | A | B | A | — |
| 3 | A | A | A | B | A | — |
| 4 | A | A | A | A | A | 15.7 |
| 5 | A | A | A | A | A | 8.3 |
| 6 | A | A | A | A | A | 6.1 |
| 7 | B | A | A | A | A | 11.7 |
| 8 | C | A | A | A | A | 8.9 |
| 9 | D | A | A | A | A | 8.5 |
| 10 | E | A | A | A | A | 6.8 |
| 11 | F | A | A | A | A | 7.1 |
| 12 | G | A | A | A | A | 6.1 |
| 13 | H | A | A | A | A | 5.5 |
| 14 | I | A | A | A | A | 5.8 |
| 15 | J | A | A | A | A | 5.7 |
| 16 | K | A | A | A | A | 5.2 |
| 17 | L | A | A | A | A | 6.5 |
| 18 | M | A | A | A | A | 6.6 |
| 19 | N | A | A | A | A | 6.7 |

| Test No. | Maximum Flaw Depth of Inner Peripheral Surface (μm) | Corrosion Fatigue Property | Total Evaluation | Note |
|---|---|---|---|---|
| 1 | 22 | C | C | Due to hydrostatic extrusion, much decarburization: x |
| 2 | — | C | C | Due to high heating temperature and slow cooling rate, ferrite decarburization and total decarburization: x |
| 3 | — | C | C | Due to high heating temperature, total decarburization: x |
| 4 | 6 | B | B | Due to low reduction of area, large grain size |
| 5 | 5.3 | A | A | — |
| 6 | 4.3 | A | A | — |
| 7 | 7.1 | B | B | — |
| 8 | 5.4 | A | A | — |
| 9 | 6.1 | A | A | — |
| 10 | 7.2 | A | A | — |
| 11 | 6.3 | A | A | — |
| 12 | 5.9 | A | A | — |
| 13 | 5.2 | A | A | — |
| 14 | 6.2 | A | A | — |
| 15 | 6.5 | A | A | — |
| 16 | 5.7 | A | A | — |
| 17 | 6.1 | A | A | — |
| 18 | 6.6 | A | A | — |
| 19 | 6.7 | A | A | — |

While the invention has been described in detail and with reference to specific embodiments thereof, it will be apparent to one skilled in the art that various changes and modifications can be made therein without departing from the spirit and scope thereof.

This application is based on Japanese Patent Application No. 2009-119030 filed on May 15, 2009, and the entire subject matter of which is incorporated herein by reference.

INDUSTRIAL APPLICABILITY

In the invention, a chemical component composition of a steel as a material is properly adjusted, and production conditions thereof are strictly defined, thereby being able to realize a hollow seamless pipe, in which no ferrite decarburization is occurred in an inner peripheral surface and outer peripheral surface and a thickness of a decarburized layer is reduced as much as possible. It becomes possible to secure sufficient fatigue strength for a spring formed from such a hollow seamless pipe.

The invention claimed is:

1. A hollow seamless pipe, comprising: a steel material comprising 0.2 to 0.7 mass % of C, 0.5 to 3 mass % of Si, 0.1 to 2 mass % of Mn, more than 0 mass % and 0.1 mass % or less of Al, more than 0 mass % and 0.02 mass % or less of P, more than 0 mass % and 0.02 mass % or less of S, more than 0 mass % and 0.02 mass % or less of N, and Fe, wherein a C content in an inner peripheral surface and an outer peripheral surface of the hollow seamless pipe is 0.10 mass % or more, a thickness of a whole decarburized layer in each of the inner peripheral surface and the outer peripheral surface of the hollow seamless pipe is 200 μm or less, and an average grain size of ferrite in an inner surface layer part of the hollow seamless pipe is 11.7 μm or less.

2. The hollow seamless pipe according to claim wherein a maximum depth of a flaw present in the inner peripheral surface of the hollow seamless pipe is 20 μm or less.

3. The hollow seamless pipe according to claim 1 or claim 2, further comprising: at least one selected from the group consisting of groups (a) to (g):

(a) more than 0 mass % and 3 mass % or less of Cr, (b) more than 0 mass % and 0.015 mass % or less of B, (c) one or more elements selected from the group consisting of more than 0 mass % and 1 mass % or less of V, more than 0 mass % and 0.3 mass % or less of Ti, and more than 0 mass % and 0.3 mass % or less of Nb, (d) one or more elements selected from the group consisting of more than 0 mass % and 3 mass % or less of Ni, and more than 0 mass % and 3 mass % or less of Cu, (e) more than 0 mass % and 2 mass % or less of Mo, (f) one or more elements selected from the group consisting of more than 0 mass % and 0.005 mass % or less of Ca, more than 0 mass % and 0.005 mass % or less of Mg, and more than 0 mass % and 0.02 mass % or less of REM, and (g) one or more elements selected from the group consisting of more than 0 mass % and 0.1 mass % or less of Zr, more than 0 mass % and 0.1 mass % or less of Ta, and more than 0 mass % and 0.1 mass % or less of Hf.

4. The hollow seamless pipe according to claim 1, wherein the average grain size of ferrite in an inner surface layer part of the hollow seamless pipe is 10 μm or less.

5. The hollow seamless pipe according to claim 4, wherein a JIS Z2274 fatigue specimen of the hollow seamless pipe has no breakage occurred up to $2.0\times10^5$ cycles in a corrosion fatigue test.

* * * * *